United States Patent [19]

Janko

[11] 4,075,533

[45] Feb. 21, 1978

[54] ELECTRON BEAM FORMING STRUCTURE UTILIZING AN ION TRAP

[75] Inventor: Bozidar Janko, Portland, Oreg.

[73] Assignee: Tektronix, Inc., Beaverton, Oreg.

[21] Appl. No.: 720,858

[22] Filed: Sept. 7, 1976

[51] Int. Cl.[2] ..... H01J 29/56

[52] U.S. Cl. ..... 315/31 R; 313/424; 313/445

[58] Field of Search ..... 313/424, 445, 449; 315/31 R

[56] References Cited

U.S. PATENT DOCUMENTS

| | | | |
|---|---|---|---|
| 2,717,322 | 9/1955 | Ballard | 315/445 |
| 2,836,752 | 5/1958 | Berthold | 313/424 |
| 2,921,212 | 1/1960 | Berthold | 313/424 |
| 2,986,668 | 5/1961 | Haflinger et al. | 313/449 |

*Primary Examiner*—Maynard R. Wilbur
*Assistant Examiner*—T. M. Blum
*Attorney, Agent, or Firm*—Adrian J. LaRue

[57] ABSTRACT

An electron beam forming structure includes an anode having first and second sections spaced from each other with the first section being closest to the cathode and having a beam-admitting aperture and being connected to a positive potential and the second section having a beam-limiting aperture and being connected to ground relative to the first section. The first section will repel positive ions created in an area adjacent the beam-limiting aperture and deflect them away from the source of the electron beam so they can be collected at the second section.

5 Claims, 2 Drawing Figures

ELECTRON BEAM FORMING STRUCTURE UTILIZING AN ION TRAP

BACKGROUND OF THE INVENTION

Ion traps are known for electron discharge tubes, especially for use in cathode ray tubes as disclosed in U.S. Pat. Nos. 2,810,091; 2,836,752 and 2,921,212. The ion traps that are disclosed in these patents are used to prevent the impingement of negative ions that are carried together with an electron beam onto areas of the fluorescent screen in order to prevent darkening or discoloration of these areas which are defined as ion spots.

Positive ions are also created in electron discharge tubes and they are typically created by the impingement of electrons of the electron beams emanating from the heated cathode onto metal parts of the anode thereby creating positive metal ions or the electrons of the electron beam cause outgassing of gas molecules from the metal parts they engage which creates positive ions from these gas molecules or the electrons of the electron beam or secondary electrons therefrom create positive ions from free gas molecules that are present within the envelope of the electron discharge tube.

These positive ions can acquire kinetic energy in the vicinity of the cathode and impinge thereon thereby sputtering away cathode material and causing chemical poisoning which changes cathode structure and decreases the life of the cathode.

SUMMARY OF THE INVENTION

The present invention relates to electron discharge tubes and more particularly to electron discharge tubes having an ion trap for collecting positive ions to prevent them from impinging on the cathode.

In accordance with the present invention, an electron discharge device, which is generally a cathode ray tube, includes an electron gun structure having the usual cathode, grid, anode elements and lens elements. All except the anode element are conventional. The anode element in one embodiment has a cup-shaped member having a beam-admitting aperture in the end facing the cathode and the other end is spaced from a plate having a beam-limiting aperture therein which can be and customarily is part of the electrostatic lens. This cup-shaped member is connected to a positive potential of about ten volts to a value that does not interfere with the electron optics whereas the plate containing the beam-limiting aperture is connected to a reference potential. In this form, positive ions created by the electrons of the electron beam or secondary electrons thereof are deflected out of the electron beam and collected by the grounded plates thereby preventing them from impinging on the cathode.

The anode element is an alternative embodiment of the invention includes a plate having a beam-admitting aperture therethrough and it is connected to a positive potential like the cup-shaped member above. The plate is spaced from a cylinder having an annular member secured therein which is provided with a beam-limiting aperture. The cylinder is connected to a reference potential so that the positive ions are collected thereby.

An object of the present invention is to provide an electron discharge device having an ion trap for collecting positive ions created by electrons of the electron beam or secondary electrons thereof.

Another object of the present invention is the provision of an electron discharge device in which the anode is provided with a positive potential to repel positive ions that are created in order to prevent the positively-created ions from being impinged onto the cathode.

An additional object of the present invention is to provide an electron discharge device wherein the anode and the lens are provided with different potentials to repel and attract positive ions in order to prevent such ions from impinging onto the cathode.

A further object of the present invention is the provision of an electron discharge device in which the anode means has a positive potential that ranges from ten volts to a value that does not interfere with the electron optics of the device to deflect positive ions created by the electron beam or secondary electrons thereof out of the electron beam to prevent these positive ions from reaching the cathode.

A still further object of the present invention is to provide an electron discharge device having ion trap means to prevent positive ions from reaching the cathode means thereby preventing ion damage thereto which will result in higher cathode loading and longer cathode life.

BRIEF DESCRIPTION OF THE DRAWING

Other objects and advantages of the present invention will be apparent from the following detailed description of certain preferred embodiments thereof and from the attached drawings of which.

DETAILED DESCRIPTION OF THE INVENTION

Figure 1:
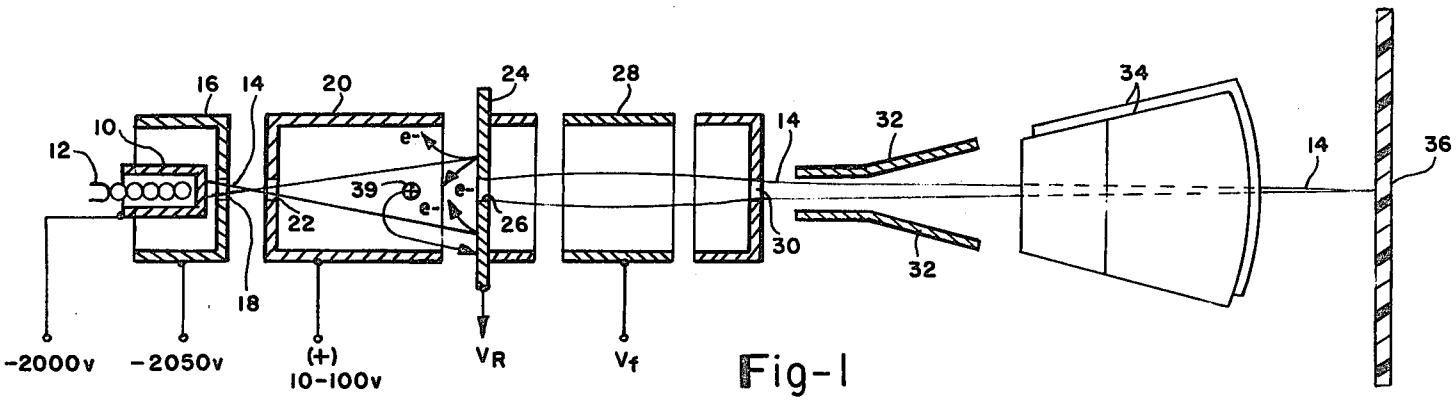
FIG. 1 is a longitudinal cross-sectional representation of internal structure of a cathode ray tube according to the present invention.

As shown in FIG. 1, one embodiment of the electron beam forming structure utilizing an ion trap includes a cathode 10 which typically is connected to a negative potential such as, for example, −2000 volts. A heater element 12 is disposed within cathode 10 in order to heat cathode 10 to enable cathode 10 to emit a beam of electrons 14. Cathode 10 is disposed within a cup-shaped grid 16 which is connected to a negative potential such as −2050 volts. Grid 16 is provided with an an aperture 18 through which electron beam 14 passes.

Anode 20 is a cup-shaped member, and it has a beam-admitting aperture 22 to admit electron beam 14 therethrough. Anode 20 is connected to a positive potential which has a range of 10–100 volts with respect to a reference potential of around 0 volts. Anode 20 is spaced from plate 24 which is provided with a beam-forming aperture 26. Plate 24 is part of an electrostatic lens system 28 of conventional design which is connected to a focusng voltage $V_f$ in order to focus the electron beam 14 as it passes therethrough and out of lens 28 through aperture 30.

After electron beam 14 passes through aperture 30 in lens 28, it passes between vertical deflection plates 32, the function of which is to move electron beam 14 in a vertical direction in accordance with signal voltages applied thereto. Electron beam 14 then passes between horizontal deflection plates 34 which moves electron beam 14 in a horizontal direction in accordance with horizontal deflection signals applied thereto. Electron beam 14 impinges onto screen 36 which is a conventional phosphor screen for emitting light at locations where electron beam 14 is caused to impinge in accordance with the deflection signals applied to vertical deflection plates and horizontal deflection plates 34. Screen 36 can take any desired form on which an electron beam impinges.

As electron beam 14 passes through beam-admitting aperture 22 into anode 20 in the form of a cone and engages plate 24 around beam-forming aperture 26. The beam that passes through beam-forming aperture 26 is the electron beam that is focused in lens 28 for further passage through aperture 30, vertical deflection plates 32, horizontal deflection plates 34 and the electron beam in its final form impinges on screen 36. When electron beam 14 engages plate 24 electrons of electron beam 14 have a large amount of energy thereby creating positive ions from the material of plate 24 as well as gas molecules that may be located within plate 24. Also, the high energy electrons from electron beam 14 in engaging plate 24 will create secondary electrons e- at a rate of around or slightly larger than 1. The secondary electrons created by the primary electrons of electron beam 14 have lower energy levels than the primary electrons and will move at a slower rate. The slow moving secondary electrons, especially at such low energy level, can engage free gas molecules and ionize them to positive ions 39, the ions removed from the gas molecules by the secondary electrons are collected on the anode.

The positive ions 38 that are created by the primary electrons of electron beam 14 or by the secondary electrons thereof are essentially slow moving positive ions which are attracted to the electron beam 14 via space charge created by electrons and gain essentially no energy until they reach the area between the grid 16 and anode 20. In this area they obtain substantially increased kinetic energy causing them to be attracted to and impinged on cathode 10 thereby sputtering away cathode material and/or causing chemical poisoning which changes cathode structure which results in decreased loading capacity and life of the cathode.

As a result of anode 20 having a positive potential of 10–100 volts, a voltage barrier is created across the space between anode 20 and plate 24 which is connected to ground and such voltage barrier 39 repels positive ions 39 out of electron beam 14 and away from cathode 10; these positive ions are collected on plate 24 as illustrated by the curved arrow extending between positive ion 39 and plate 24. In this manner, the ion barrier bias voltage connected to anode 20 prevents positive ions created by the primary electrons of electron beam 14 or the secondary electrons thereof to be repelled out of the electron beam 14 and not be driven at high kinetic energy onto the cathode to damage or poison same thereby increasing the load of the cathode and the life thereof.

While anode 20 is shown as being spaced from plate 24, anode 20 can be connected to plate 24 and be split into two parts with the 10–100 volt positive potential being connected to the part of anode 20 closest to grid 16 and the other part, of course, would be connected to reference potential $V_R$ since it would be connected to plate 24.

Figure 2:
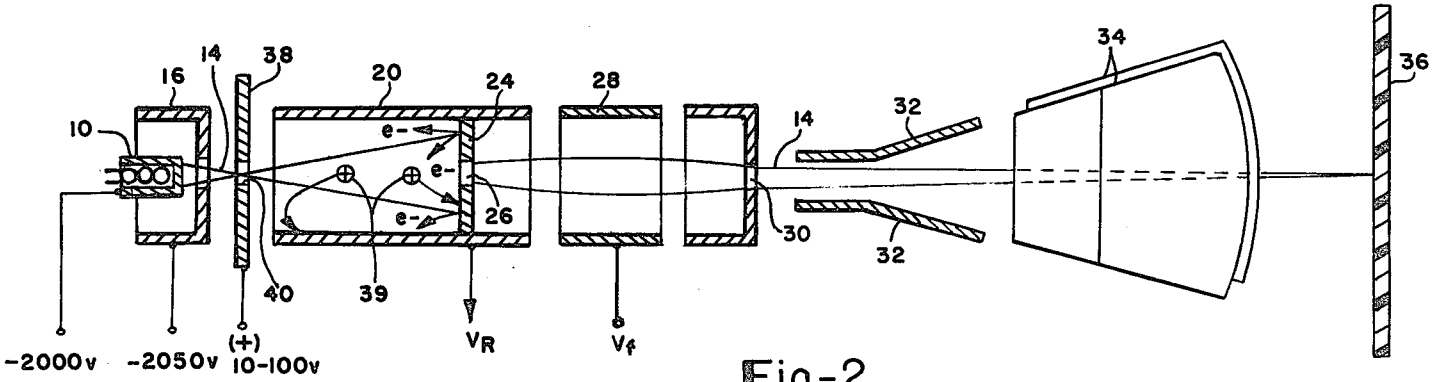
FIG. 2 is a longitudinal cross-sectional representation of an alternative embodiment of the present invention.

The FIG. 2 embodiment is identical to that of FIG. 1 except that a plate 38 is positioned between grid 16 and anode 20 and plate 24 is secured in position in the annular member forming anode 20 and part of lens 28. Plate 38 is provided with a beam-admitting aperture 40 which permits electron beam 14 to pass therethrough into anode 20 where the conically-shaped electron beam impinges on plate 24 with part of electron beam 14 passing through beamforming aperture 26 thereby forming the electron beam as it is passed into lens 28.

The primary electrons of electron beam 14 when they impinge on plate 24 around beam-limiting aperture 26, will create positive ions from the material of plate 24 or gas molecules contained within the material of plate 24 or free gas molecules around plate 24 by means of secondary electrons. Positive ions 39 that are created close to plate 24 will be attracted thereto because of it being connected to reference potential $V_R$; whereas positive ions 39 that are not attracted to plate 24 will begin slowly migrating toward plate 38 within the electron beam and as a result of plate 38 having a positive potential of 20–100 volts thereon, the positive ions 39 will be repelled by the positive potential on plate 38 toward anode 20 where they will be collected thereby. Such action will prevent the positive ions from gaining kinetic energy between anode 20 and plate 38 to be attracted onto cathode 10 and sputter away cathode material or poison the cathode to decrease its load capacity as well as its life expectency.

It can readily be discerned from the foregoing that the positive bias provided between parts of the anode or a plate and the anode creates an ion trap to prevent positive ions created by primary electrons of the electron beams or secondary electrons thereof from being attracted to the cathode thereby sputtering away part of the cathode or poisoning the cathode material which would result in reduced cathode loading or decreased cathode life.

While there has been shown and described preferred embodiments of the present invention, it will be apparent to those skilled in the art that changes and modifications may be made without departing from the present invention in its broader aspects. The appended claims are therefore intended to cover all such changes and modifications as fall within the true spirit and scope of the present invention.

The invention is claimed in accordance with the following:

1. An electron discharge device in which the improvement comprises an electron beam-forming structure including:

a cathode having a negative potential connected thereto for emitting an electron beam;

a grid electrode adjacent said cathode including an aperture through which said electron beam passes, said grid electrode having a negative potential connected thereto slightly larger than the cathode potential; anode means disposed adjacent to said grid electrode including a first section having a beam-admitting aperture for admitting the electron beam from said grid electrode into said anode means and a second section having a beam-limiting aperture for limiting the electron beam as it passes therethrough, said second section being connected to a reference potential;

and positive bias means connected to said first section of said anode to repel positive ions away from said beam-admitting aperture as said positive ions approach said beam-admitting aperture to prevent said positive ions from reaching said cathode.

2. An electron discharge device according to claim 1 wherein said first section of said anode means is a cup-shaped member spaced from said second section and said beam-admitting aperture is located in a bottom of said cup-shaped member.

3. An electron discharge device according to claim 1 wherein said first section of said anode means is a plate spaced from said second section which has a tubular configuration.

4. An electron discharge device according to claim 1 wherein said positive bias means ranges from about ten volts to a value that does not interfere with the electron optics of said device.

5. An ion trap for use in electron beam forming structure of electron discharge devices comprising:

cathode means having a negative potential connected thereto for emitting a beam of electrons;

anode means spaced from said cathode means including a first section spaced from a second section, said first section having a beam-admitting aperture for admitting said electron beam into said anode means and having a positive potential ranging from about ten volts to a value that does not interefere with the electron optics of said device to repel positive ions away from said beam-admitting aperture, said second section having a beam-limiting aperture for limiting said electron beam as it passes therethrough and having a reference potential connected thereto.

* * * * *